US005411064A

United States Patent [19]

Yamagishi

[11] Patent Number: 5,411,064

[45] Date of Patent: May 2, 1995

[54] NARROW FABRIC LOOM OPERATING MECHANISM

[75] Inventor: Kiichi Yamagishi, Niigata, Japan

[73] Assignee: Yoshida Kogyo K.K., Tokyo, Japan

[21] Appl. No.: 179,917

[22] Filed: Jan. 11, 1994

[30] Foreign Application Priority Data

Jan. 19, 1993 [JP] Japan ..... 5-006342

[51] Int. Cl.[6] ..... D03D 35/00; D03D 47/04; D03D 47/27

[52] U.S. Cl. ..... 139/449; 139/431; 139/432

[58] Field of Search ..... 139/449, 431, 432, 22, 139/442

[56] References Cited

U.S. PATENT DOCUMENTS 4,027,703 6/1977 Diesner ..... 139/22 X
4,305,434 12/1981 Muller ..... 139/431
4,657,053 4/1987 Speich ..... 139/449

FOREIGN PATENT DOCUMENTS 719083 11/1954 United Kingdom .
WO85/01524 4/1985 WIPO .
WO85/01754 4/1985 WIPO .

*Primary Examiner*—Andrew M. Falik
*Attorney, Agent, or Firm*—Hill, Steadman & Simpson

[57] ABSTRACT

In a loom, a carrier drive shaft supporting the carrier at one end horizontally, is vertically mounted on the loom frame, and the carrier drive shaft and a reed drive shaft are linked by a link via a pivotal member. With this arrangement, the carrier drive shaft will not undergo at least vertical vibration so that influence due to vibration of the reed during the inserting of the weft yarn can be reduced to a minimum, thus sharply minimizing chances that the latch needle fails to catch the weft yarn.

5 Claims, 2 Drawing Sheets

NARROW FABRIC LOOM OPERATING MECHANISM

BACKGROUND OF THE INVENTION

1. Field of the Invention:

This invention relates to a loom for weaving a narrow-width woven cloth such as a ribbon or tape by driving a number of members such as a reed, a carrier and a latch needle in time relation with one another by a single main drive shaft, and more particularly to a loom having a structure such that a carrier connected to a reed is prevented to the utmost from being influenced by vibration due to the action of the reed.

2. Description of the Related Art

The aforementioned conventional loom is exemplified by U.S. Pat. No. 4,305,434, U.K. Pat. No. 2,119,414 and International Patent Application Laid-Open Specification No. 84/00157.

In the loom disclosed in the aforementioned U.S. Patent, a crank journal rotatable as a unit with a single horizontal main drive shaft is connected to the respective free ends of a reed driving pivotal arm and a carrier driving pivotal arm, which are fixed at one ends respectively to reed and carrier drive shafts parallel to the main drive shaft, by two links for converting rotation of the main drive shaft into pivotal motion of the pivotal arms. The base end of the reed is fixed to the reed drive shaft to perform the beating action in timed relation with pivotal. motion of the reed driving pivotal arm. One end of the other pivotal arm is fixed to the carrier drive shaft, and the free end of the same pivotal arm is connected to the base end of the vertical carrier pivotal shaft via a link for converting horizontal pivotal motion of the pivotal arm into forward and reverse vertical rotations of the carrier pivotal shaft so that the free end of the carrier will move back and forth in the shed of warp yarns to carry the weft yarn.

Also a latch needle for forming the selvedge and a catch sled for guiding a selvedge yarn are operable in accordance with rotation of the main drive shaft.

According to the loom disclosed in the above-mentioned U.K. Patent, the reed pivotally movable in response to rotation of the main drive shaft is connected to the base of the carrier, whose one end is horizontally pivoted, directly by a link so that the free end of the carrier will move back and forth in a horizontal plane in timed relation with pivotal motion of the reed.

The loom disclosed in the above-mentioned International Patent Application Specification is equipped with a drive mechanism similar to that of the loom disclosed in the above-mentioned U.S. Patent. Specifically, in the loom disclosed the U.S. Patent, the carrier driving pivotal arm is connected to the crank journal via a link. Whereas in the loom disclosed in the International Patent Application Specification, the carrier driving pivotal arm is connected to the reed driving pivotal arm directly by a link.

However, in the cooperating mechanism of the reed and carrier in the loom disclosed in the U.K. Patent, since vibration of the reed is transmitted directly to the carrier, the weft yarn is apt to be vibrated in a complicated manner during the action of the carrier so that the latch needle would tend to fail to catch the weft yarn.

In the looms disclosed the U.S. Patent and the International Patent Application Specification, since a number of links exist between the carrier driving pivotal arm and the carrier, it results in a complicated structure.

Especially in the loom disclosed in the International Patent Application Specification, since the carrier driving pivotal arm and the reed driving pivotal arm are directly connected to each other by a link, vibration of the link also is transmitted to the carrier so that the weft yarn will undergo a complicated vibration likewise the loom disclosed in the U.K. Patent and hence the latch needle would tend to fail to catch the weft yarn.

SUMMARY OF THE INVENTION

It is an object of this invention to provide a loom in which a reed, a carrier, a latch needle, a catch sled, etc. are driven in timed relation with one another by a common drive shaft, especially the carrier, and are prevented to the utmost from being influenced by vibration of the reed, and in which a power transmission mechanism is simplified to make the entire loom simple in structure.

In order to accomplish the above object, according to the invention, there is provided a loom in which a reed, a carrier, a latch needle, a catch sled, etc. are to be driven in timed relation with one another by driven rotation of a main drive shaft, comprising: a carrier drive shaft rotatably mounted vertically on a loom frame and supporting the carrier and a pivotal member horizontally; and a carrier driving pivotal arm connected to the pivotal member via a link, the pivotal arm being fixed at one end to a horizontal reed drive shaft.

As the main drive shaft is rotated, the reed driving pivotal arm connected to the crank journal via the reed driving link is pivotally moved to rotate the reed drive shaft forwardly and reversely, thus causing the reed to perform the beating action. At the same time, the rotation of the reed drive shaft causes the carrier driving pivotal arm to pivotally move, which causes the carrier driving pivotal member to pivotally move in a horizontal plane about the carrier drive shaft via the carrier driving link, thus causing the carrier drive shaft to rotate about a vertical axis forwardly and reversely. In response to the forward and reverse rotations of the carrier drive shaft, the carrier arm is pivotally moved to move the carrier back and forth in the shed of warp yarns to insert the weft yarn into the shed. At that time, each time the weft yarn makes a single round running, the reed also makes a single forward and backward stroke to perform a single beating action and, at the same time, the catch sled and the latch needle are actuated to knit the turn of the weft yarn with the selvedge yarn, thus forming a selvedge as usual.

During the beating, a great impact is exerted on the reed, and the reed would undergo an extremely severe vibration as the loom is operated at high speed. At that time, according to this invention, it is possible only incompletely to prevent the carrier from being influenced by the vibration of the carrier drive shaft about the axis among vibration components of the reed; however of design interest is the carrier's vibration in the weft inserting direction so that the weft yarn can be caught by the latch needle without fail. Since the carrier drive shaft is rotatable but is connected at one end firmly with the loom frame integrally thereof, the carrier drive shaft will hardly be influenced by the axial vibration components so that no vertical vibration will be transmitted to the carrier, thus causing no vertical waving of the weft yarn.

DETAILED DESCRIPTION

Figure 1:
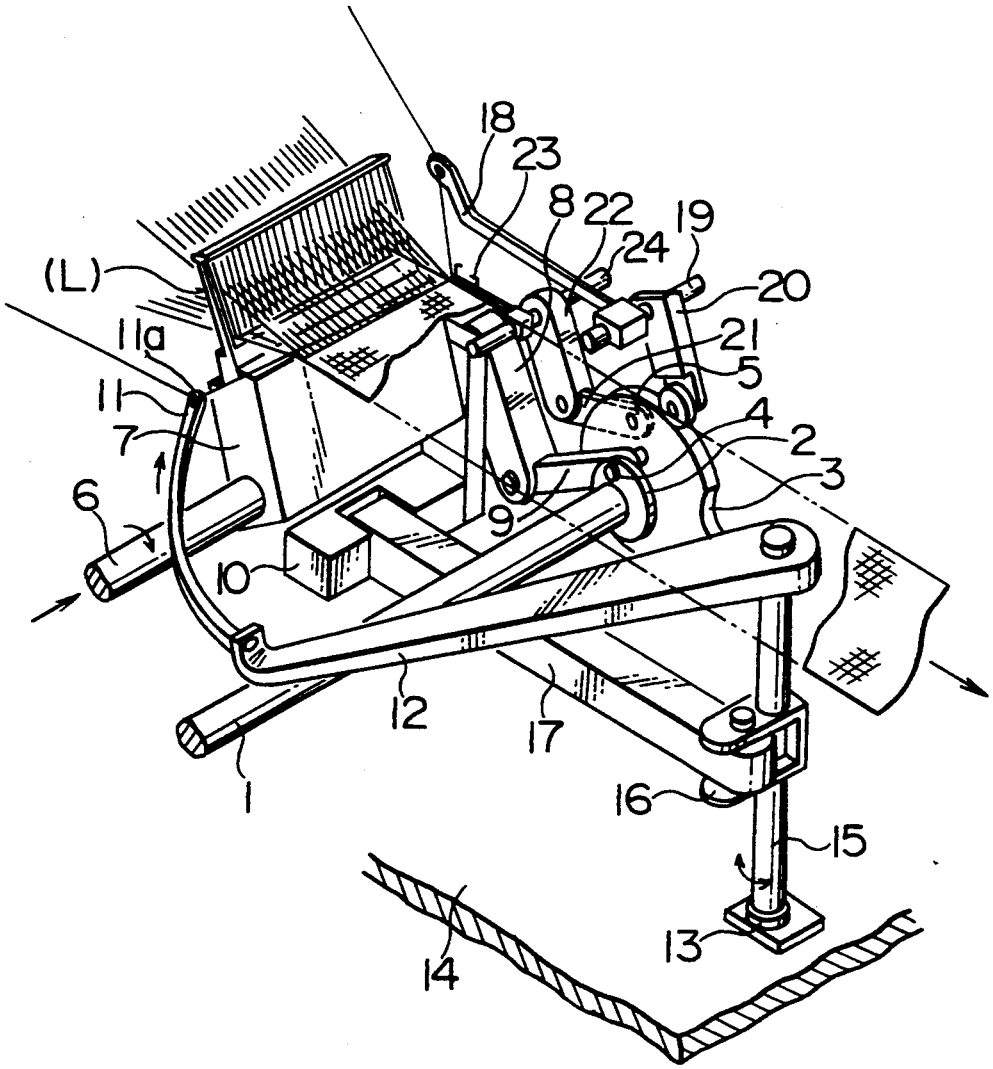
FIG. 1 is a fragmentary perspective view showing the drive part of a loom according to a typical embodiment of this invention.
Figure 2:
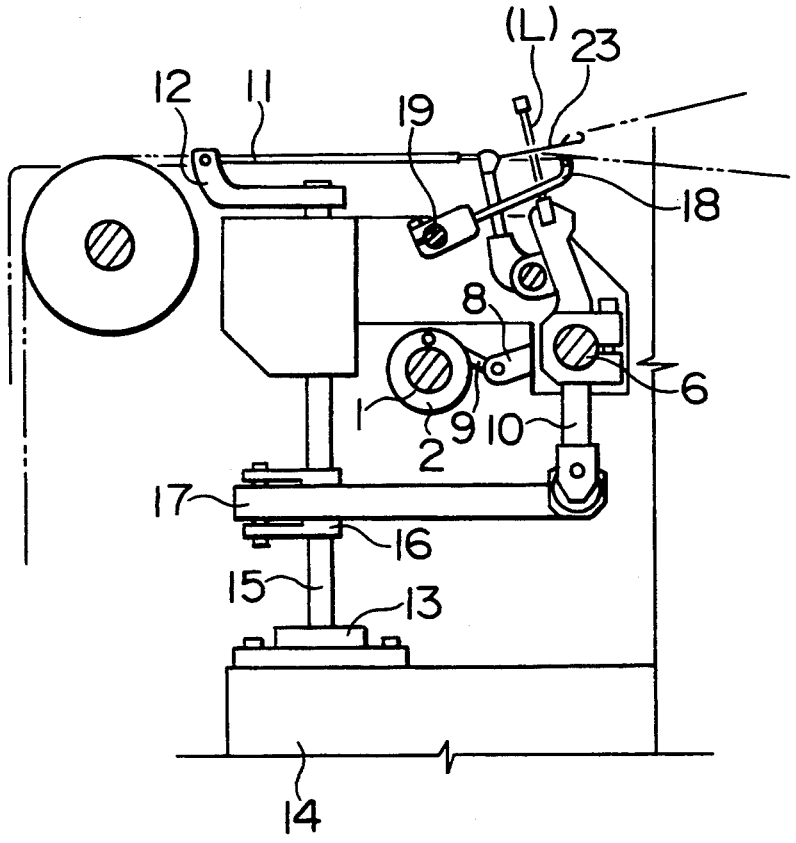
FIG. 2 is a side view of FIG. 1.

An illustrated embodiment of this invention will now be described in detail. FIG. 1 is a fragmentary perspective view showing the drive part of a loom according to a typical embodiment of the invention, and FIG. 2 is a side view of FIG. 1.

In these drawings, reference numeral 1 designates a main drive shaft which is horizontally supported on a portion of a non-illustrated loom frame and is to be rotated at high speed by a non-illustrated power source. To one end portion of the main drive shaft 1, a disc 2 and an eccentric cam 3 are fixed. A crank journal 4 is attached to the disc 2 at an eccentric position, and a crank pin 5 is attached to the eccentric cam 3 at an eccentric position.

Reference numeral 6 designates a reed drive shaft which is parallel to the main drive shaft 1 and to which the lower portion of a reed support member 7 is fixed as by a key joint and also one end of a pivotal arm 8 is fixed. The other end of the pivotal arm 8 and the crank journal 4 of the main drive shaft 1 are connected with each other via a reed driving link 9. To the reed drive shaft 6, the upper end of an L-shaped carrier driving pivotal arm 10 is fixed.

Reference numeral 11 designates a carrier in the form of an arcuate member which has in its free end a weft yarn insertion hole 11*a* and is fixed at its base end to one end of a carrier arm 12. The base end of the carrier arm 12 is fixed to a carrier drive shaft 15, which is mounted on a loom frame 14 via a bearing 13, in such a manner that the plane including the carrier 11 and the carrier arm 12 is horizontal. Therefore, the carrier drive shaft 15 is rotatable about an vertical axis, and the carrier arm 12 is attached to the carrier drive shaft 15 at such a height or level that the carrier 11 can move back and forth in the shed of warp yarns. To a central portion of the carrier drive shaft 15, the base end of a generally C-shape pivotal member 16 is fixed. The free end of the pivotal member 16 is connected to the lower end of the carrier driving pivotal arm 10, which is fixed to the reed drive shaft 6, via a carrier driving link 17.

On a cam surface of the eccentric cam 3 fixed to the end of the main drive shaft 1, a cam follower 20 pivoted on a pivot portion 19, on which the base end of a catch sled 18 for guiding a selvedge yarn is pivoted, is resiliently resting. To the crank pin 5 attached to the eccentric position of the eccentric cam 3, a latch needle drive shaft 24 to which a latch needle 23 is fixed is connected via a link 21 and a pivotal arm 22.

According to the loom of this invention, as the main drive shaft 1 is rotated, the reed driving pivotal arm 8 connected to the crank journal 4 via the reed driving link 9 is pivotally moved to rotate the reed drive shaft 6 forwardly and reversely, thereby actuating the reed (L) via the reed support member 7 to perform the beating action. The rotation of the reed drive shaft 6 causes the carrier driving pivotal arm 10 to pivotally move so that the carrier driving pivotal member 16 is pivotally moved about the carrier drive shaft 15 in a horizontal plane via the carrier driving link 17, thereby causing the carrier drive shaft 15 to rotate about the vertical axis forwardly and reversely. In response to the forward and reverse rotations of the carrier drive shaft 15, the carrier arm 12 is pivotally moved to move the weft yarn insertion hole 11*a* of the carrier 11 back and forth in the shed of warp yarns, thereby inserting the weft yarn into the shed.

Each time the weft yarn makes a single forward and backward stroke, the reed (L) also will make a single forward and backward stroke to perform a single beating action. As a result, the weft yarn inserted into the shed of warp yarns is in the form of a double yarn, and the turn of the weft yarn is knitted with a selvedge yarn, as usual, by the catch sled 18 and the latch needle 23 which are operated via the above-described power transmission mechanism.

During the beating, a great impact is exerted on the reed, and the reed would undergo an extremely severe vibration as the loom is operated at high speed. According to the conventional mechanism, vibrations of the reed (L) is exerted also on the carrier 11 so that the weft yarn would undergo complicated vibrations, which would be a cause for the latch needle 23 to fail to catch the weft yarn. Whereas according to this invention, it is possible to only incompletely prevent the carrier 11 from being influenced by the vibration of the carrier drive shaft 15 about the axis among vibration components of the reed (L); however this vibration is the carrier's vibration in the weft inserting direction so that the weft can be caught by the latch needle without fail if the vibration components are considered when designing. Since the carrier drive shaft 15 is rotatable but is connected at one end firmly with the loom frame 14 integrally thereof, the carrier drive shaft 15 will hardly be influenced by the axial vibration components so that no vertical vibration will not be transmitted to the carrier 11, thus causing no vertical waving of the weft yarn.

As is apparent from the foregoing description, according to the loom of this invention, the carrier drive shaft supporting the carrier at one end horizontally with respect to the horizontal reed drive shaft is vertically mounted on the loom frame, and the carrier drive shaft and the reed drive shaft are linked by a link via the respective pivotal means. Even with this simple structure, the carrier drive shaft will not undergo at least vertical vibration so that influence due to vibration of the reed during the inserting of the weft yarn can be reduced to a minimum, thus sharply minimizing chances that the latch needle fails to catch the weft yarn.

What is claimed is:

1. A loom in which a reed, a carrier, a latch needle, a catch sled are to be driven in timed relation with one another by driven rotation of a main drive shaft, comprising:

(a) a carrier drive shaft rotatably mounted vertically on a loom frame and supporting said carrier and a pivotal member horizontally; and (b) an L-shaped carrier driving pivotal arm connected to said pivotal member via a link, said pivotal arm being fixed at one end to a horizontal reed drive shaft said reed drive shaft, connected to said reed and being adapted to rotate forwardly and reversely to move said reed back and forth, said L-shaped pivotal arm extending beneath said reed drive shaft to said link, whereby said rotation of the reed drive shaft through said L-shaped arm and said link causes a back and forth rotation of the carrier drive shaft.

2. A loom operating mechanism, comprising:

a loom frame;

a horizontally oriented main drive shaft;

a carrier drive shaft rotatively mounted in a vertical orientation on said loom frame;

a carrier arm extending horizontally from said carrier drive shaft;

a carrier extending from an end of said carrier arm and having a weft yarn insertion hole at a free end thereof;

a pivotal member extending horizontally from said carrier drive shaft below said carrier arm;

a reed drive shaft;

a reed generally extending upwardly and mounted at a bottom end thereof on said reed drive shaft, said reed drive shaft mounted to said loom frame for rotary movement about an axis thereof;

an eccentric means operatively connected to said main drive shaft and said reed drive shaft for converting rotation of said main drive shaft into a back and forth rotation of said reed drive shaft;

a carrier driving pivotal arm arranged below said reed drive shaft and having a lever extending upwardly to connect fixedly to an end of said reed drive shaft;

a link connected between said carrier driving pivotal arm and said pivotal member, rotation of said reed drive shaft causing pivoting of said carrier driving pivotal arm, which in turn causes back and forth translation of said link, which in turn causes back and forth pivoting of said carrier drive shaft, causing back and forth pivoting of said carrier arm and said carrier.

3. The loom operating mechanism according to claim 2, wherein said means for causing back and forth rotation of said reed drive shaft comprises:

a disk mounted around said main drive shaft;

a reed driving link pivotally connected to said disk at one end thereof;

a pivotal arm rotatively connected to an opposite end of said reed driving link and fixedly connected to said reed drive shaft at an opposite end thereof.

4. The loom operating mechanism according to claim 3, further comprising:

an eccentric cam fixedly mounted to said main drive shaft for rotation therewith;

a latch needle drive shaft mounted for rotation with respect to said frame;

a latch needle fixed to said latch needle drive shaft;

a latch needle link rotatively connected eccentricly to said eccentric cam at one end thereof;

a pivotal arm rotatively connected to said latch needle link at an opposite end thereof, and said pivotal arm fixedly connected at an opposite end thereof to said latch needle drive shaft, wherein rotation of said eccentric cam causing up and down pivoting of said latch needle.

5. The loom operating mechanism according to claim 4, wherein said eccentric cam comprises a cam surface, and further comprising:

a cam follower;

a pivot axle mounted for rotation with respect to said frame and fixedly connected to one end of said cam follower, an opposite end of said cam follower in contact with said cam surface of said eccentric cam; and a catch sled for guiding a selvedge yarn being fixedly connected to said pivot axle and having a catch sled hole at a free end thereof for guiding said selvedge yarn.

* * * * *